US009537228B2

(12) United States Patent
Wendt et al.

(10) Patent No.: US 9,537,228 B2
(45) Date of Patent: Jan. 3, 2017

(54) ELECTRIC CONNECTION TERMINAL

(71) Applicant: PHOENIX CONTACT GMBH & CO. KG, Blomberg (DE)

(72) Inventors: Andreas Wendt, Berlin (DE); Fredrik Brand, Schieder-Schwalenberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/023,707

(22) PCT Filed: Sep. 23, 2014

(86) PCT No.: PCT/EP2014/070176
§ 371 (c)(1),
(2) Date: Mar. 22, 2016

(87) PCT Pub. No.: WO2015/040231
PCT Pub. Date: Mar. 26, 2015

(65) Prior Publication Data

US 2016/0261053 A1 Sep. 8, 2016

(30) Foreign Application Priority Data

Sep. 23, 2013 (DE) ..... 10 2013 110 475

(51) Int. Cl.
*H01R 4/48* (2006.01)
*H01R 4/52* (2006.01)
*H01R 4/50* (2006.01)

(52) U.S. Cl.
CPC ..... *H01R 4/52* (2013.01); *H01R 4/5008* (2013.01)

(58) Field of Classification Search
CPC ..... H01R 4/52; H01R 4/5008
USPC ..... 439/822, 838, 819
See application file for complete search history.

(56) References Cited

U.S. PATENT DOCUMENTS

| | | | | |
|---|---|---|---|---|
| 8,388,358 | B2 * | 3/2013 | Thompson | H01R 4/4827 439/76.1 |
| 8,727,819 | B2 * | 5/2014 | Giefers | H01R 4/489 439/441 |
| 2008/0108254 | A1 * | 5/2008 | Eppe | H01R 4/4836 439/729 |
| 2008/0233782 | A1 * | 9/2008 | Hoppmann | H01R 4/4827 439/259 |

(Continued)

FOREIGN PATENT DOCUMENTS

| | | | |
|---|---|---|---|
| DE | 1928580 | A1 | 12/1970 |
| GB | 943493 | A | 12/1963 |
| WO | WO 2013004343 | A1 | 1/2013 |

*Primary Examiner* — Abdullah Riyami
*Assistant Examiner* — Nelson R Burgos-Guntin
(74) *Attorney, Agent, or Firm* — Leydig, Voit & Mayer, Ltd.

(57) ABSTRACT

A connection terminal for connecting at least one conductor to a current bar, which is accommodated on a mount, in an electrically contacting manner, includes at least one clamping spring for applying a clamping force, the at least one clamping spring including a pivotable clamping lever for clamping the conductor. The clamping spring has a first leg and at least a second leg, is hingedly coupled to the clamping lever by the first leg, and is hingedly coupled to an auxiliary lever by the second leg, the clamping lever and the auxiliary lever being arranged pivotally on the mount.

20 Claims, 4 Drawing Sheets

(56) References Cited

U.S. PATENT DOCUMENTS

| | | | | |
|---|---|---|---|---|
| 2011/0151699 | A1* | 6/2011 | Schafmeister | H01R 4/4836 439/266 |
| 2011/0223795 | A1* | 9/2011 | Schafmeister | H01R 4/4836 439/370 |
| 2013/0157520 | A1* | 6/2013 | Koellmann | H01R 4/4836 439/834 |
| 2014/0134892 | A1* | 5/2014 | Wendt | H01R 4/5008 439/709 |
| 2015/0044897 | A1* | 2/2015 | Wu | H01R 4/48 439/352 |
| 2015/0162671 | A1* | 6/2015 | Hoppmann | H01R 4/4854 439/370 |
| 2016/0056548 | A1* | 2/2016 | Wendt | H01R 4/5008 439/725 |
| 2016/0149319 | A1* | 5/2016 | Wendt | H01R 4/5008 439/863 |
| 2016/0190713 | A1* | 6/2016 | Wu | H01R 4/4836 439/733.1 |
| 2016/0204526 | A1* | 7/2016 | Wu | H01R 4/4809 439/816 |
| 2016/0211592 | A1* | 7/2016 | Wendt | H01R 4/5008 |
| 2016/0211612 | A1* | 7/2016 | Wendt | H01R 13/639 |
| 2016/0218450 | A1* | 7/2016 | Wendt | H01R 4/4836 |

* cited by examiner

ELECTRIC CONNECTION TERMINAL

CROSS-REFERENCE TO PRIOR APPLICATIONS

This application is a U.S. National Phase application under 35 U.S.C. §371 of International Application No. PCT/EP2014/070176, filed on Sep. 23, 2014, and claims benefit to German Patent Application No. DE 10 2013 110 475.4, filed on Sep. 23, 2013. The International Application was published in German on Mar. 26, 2015 as WO 2015/040231 A1 under PCT Article 21(2).

FIELD

The present invention relates to an electric connection terminal for connecting at least one conductor and in particular to an electric connection terminal which is also suitable for connecting conductors with large cross sections.

BACKGROUND

Various connection terminals that are suitable for connecting conductors with large cross sections have become known in prior art. For example, conductors with large cross sections can be connected to screw terminals. In the process, the conductor is clamped to the electric connection terminal by means of a screw connection. A disadvantage with such screw terminals, however, is that simply pivoting the stripped conductor in from above is not readily possible. This leads to assembly being made considerably more difficult, in particular in the case of large and solid conductors, since the conductor has to be bent and inserted into the screw terminal axially from the front before the conductor can be clamped.

In the case of an electric connection terminal that allows a conductor that is to be connected to be pivoted in from above, assembly is comparatively easier. In the process, the conductor that is to be connected can be trimmed to the appropriate length beforehand and is then pivoted in during assembly.

Such a connection terminal has become known from WO 2013/004343 A1. In this known electric connection terminal, the clamping lever comprises a plurality of clamping springs and a clamping foot at the end of the clamping springs, in order to clamp an accommodated conductor to the current bar. The clamping lever is connected to a manual lever by means of which the actuation takes place. As a result of this, a dynamic transmission ratio during the closing process and a high clamping force can be achieved. A disadvantage with the known connection terminal is the relatively complicated construction of the clamping lever, for which the individual clamping springs are difficult to produce and on which settling phenomena may also possibly occur.

SUMMARY

A connection terminal for connecting at least one conductor to a current bar, which is accommodated on a mount, in an electrically contacting manner, includes at least one clamping spring for applying a clamping force; and a pivotable clamping lever configured to clamp the conductor. The clamping spring has a first leg and a second leg, is hingedly coupled to the clamping lever by the first leg, and is hingedly coupled to an auxiliary lever by the second leg, the clamping lever and the auxiliary lever being arranged pivotally on the mount.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
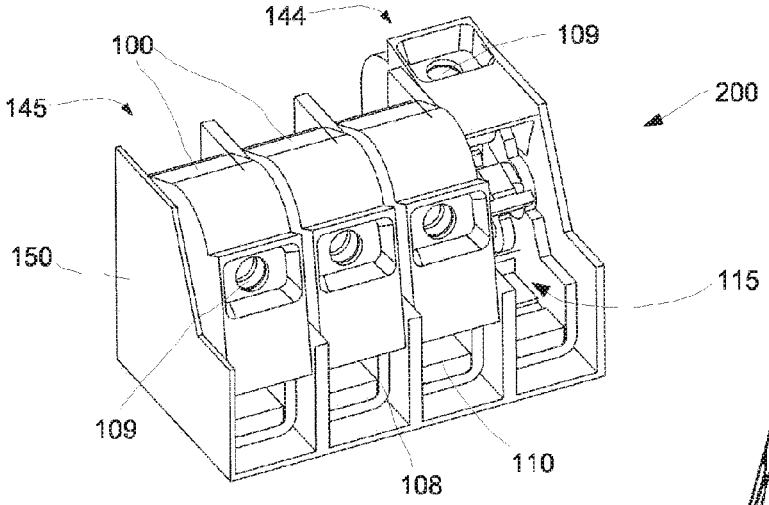
FIG. 1 is a perspective view of a terminal block having a plurality of connection terminals according to the invention.

An electric connection terminal according to the invention serves to connect at least one conductor of a current bar, which is accommodated on a mount, in an electrically contacting manner. At least one clamping spring for applying a clamping force is provided. A pivotable clamping lever serves to clamp the conductor. In the process, the clamping spring has a first leg and at least a second leg. The clamping spring is hingedly coupled to the clamping lever by the first leg. The clamping spring is hingedly coupled to the auxiliary lever by the second leg. The auxiliary lever and the clamping lever are arranged pivotally on the mount.

The electric connection terminal according to the invention has many advantages since it allows for a structure with fewer components and with simply designed components. Because a frictional fit ensues from the mount via the clamping lever, the clamping spring and the auxiliary lever, an even greater clamping force on the one hand and an even greater opening angle on the other hand can be achieved with relatively few and simply designed components.

The mount can also be described as a clamping body and serves to accommodate the current bar and to pivotally attach the clamping lever.

The electric connection terminal according to the invention provides a tilting lever terminal with dynamic lever transmission.

Preferably, an opening angle between the current bar and the clamping edge in the open state is at least 45°. In particular, the opening angle or the maximum opening angle is greater than 60° and preferably greater than 75°. Opening angles of 90° and even more than 90° are possible and preferable. As a result of large opening angles and a pivot-in region that is freely accessible from above, simple assembly of conductors even with large cross sections is facilitated since the conductors can be pivoted into the connection terminal easily from "above", i.e. from the side opposite the current bar. It is not necessary to bend and push back the normally rigid conductors in order to then insert the conductor into the connection terminal from the front.

Preferably, a first pivot pin and at least a second pivot pin at a distance therefrom are provided on the clamping lever. In particular, the clamping spring has a first pin receptacle and at least a second pin receptacle which is at a distance therefrom and in particular parallel thereto. Preferably, the auxiliary lever is equipped with a first rotating unit and at least a second rotating unit which is at a distance therefrom and in particular parallel thereto. This means that the clamping lever, the clamping spring and preferably the auxiliary lever each have two separate joints which are remote from one another and are in particular parallel.

Preferably, the clamping lever is attached pivotally on the mount by means of the first pivot pin. In particular, the first pin receptacle of the clamping spring is provided on the first leg of the clamping spring and the second pin receptacle of the clamping spring is provided on the second leg of the clamping spring. Preferably, the first pin receptacle of the clamping spring arranged on the first leg is coupled to the second pivot pin of the clamping lever.

Advantageously, the first rotating unit of the auxiliary lever has a pin which is rotatably connected to the second pin receptacle on the second leg of the clamping spring. In particular, the second rotating unit of the auxiliary lever is arranged pivotally on the mount.

Preferably, the second rotating unit of the auxiliary lever has a rounded external contour, which is accommodated pivotally on a matching rounded recess in the mount. More preferably, the external contour and the recess each have a circular shape or the shape of the segment of a circle. In particular, the second rotating unit of the auxiliary lever is pivotally or rotatably accommodated and preferably supported on the rounded external contour of the mount.

It is possible and preferable for the second rotating unit of the auxiliary lever to comprise an opening into which a guide pin is inserted. In the process, the second rotating unit can pivot at the opening by means of the guide pin. It is, however, also possible that the guide pin in the opening does not serve to transmit forces, but rather essentially only serves to guide. The guide pin can, for example, be part of the housing and, for example, consist of a plastics journal which is pivoted or clipped into the opening. It is, however, also possible for the guide pin to be a pin on the mount or to be inserted separately into the mount in order to accommodate and/or support the auxiliary lever pivotally on the second rotating unit.

In all of the embodiments it is preferable for the clamping spring to be part of an actuating unit. In a simple embodiment, the actuating unit only consists of the clamping spring. The clamping spring preferably has a dual function: the clamping spring serves to apply the clamping force and simultaneously acts as an actuating lever.

At least one tool opening is provided in the actuating unit in order to introduce a tool and actuate the electric connection terminal in order, for example, to clamp an electric conductor or to undo the clamping.

The actuating unit preferably has a tool receptacle. The tool receptacle can be provided on an insert. It is possible and preferable for the clamping spring, for example, to have a substantially C-shaped cross section and for the internal region of the cross section to be at least partially occupied by the insert. The tool receptacle, which acts as a counter-bearing during actuation in order to transmit the actuation forces, can be provided on the insert.

The insert can, for example, consist of plastics material. It is also possible, however, for the tool receptacle and/or a counter-bearing to be provided by lugs bent around the clamping spring or similar.

Preferably, an inner diameter of the tool opening is greater than an inner diameter of the tool receptacle. Many options result from this since various angles of the tool receptacle on the insert can be provided for example for different geometries and intended uses of the electric connection terminal. Depending on accessibility and geometric conditions, the alignment of the tool receptacle on the insert can have different angles to the surface of the tool opening in the clamping spring. A different configuration of the entire connection terminal can thus be facilitated as a result of different inserts. As a result of this, different connection terminals can be used for more applications just by replacing a single simple component, without substantially increasing the required stocks of parts.

The tool receptacle preferably extends transversely to the current bar. The angle between the tool receptacle and the current bar can vary in the open state and depends on the intended purpose.

The actuating unit preferably acts on the clamping lever via the auxiliary lever.

In simple embodiments, the actuating unit practically only consists of the clamping spring, in which the tool opening is provided. It is also possible for a lever extension or similar to be provided on the clamping spring in order to be able to actuate the connection terminal even without an additional tool.

In more preferable embodiments, the clamping spring acts as a tension spring, at least in the clamped state. In particular, the clamping spring is substantially relieved of tension at least in the open state. More preferably, the clamping spring is fully relieved of tension in the open state. The term "substantially relieved of tension" in the context of the present invention is taken to mean in particular an effective force that is smaller than 10% of the maximum provided clamping force.

In all of the embodiments it is preferable for the clamping lever to be behind a dead-centre in the clamped state. As a result of this, an application of force is initially required to transfer the clamping lever from the clamped state into the open position again. This leads to self-locking and self-retention of the clamped state and increases safety. This is preferably achieved in that the clamping spring acting as a tension spring can contract again slightly before reaching the clamped state such that the tension declines slightly.

In all of the embodiments it is preferable for the end of the first leg and/or the end of the second leg of the clamping spring to each be bent in order to form the first and/or the second pin receptacle. This allows for simple production of the clamping spring and reliable functioning.

In more preferable embodiments of the invention, at least the mount and the clamping lever and the auxiliary lever are designed to be punched bent parts. This allows for particularly simple and cost effective production and assembly.

Preferably, at least one groove is provided in the current bar in order to secure a conductor that is accommodated and clamped on the current bar. More preferably, the groove in the current bar is provided transversely to the insertion opening and is arranged at least roughly where the clamping lever clamps the conductor against the current bar.

Preferably, at least one penetration guard is provided, which prevents an accommodated conductor from passing through the connection terminal. For example, such a penetration guard can consist of a part that is accommodated in a further or another groove in the current bar and is inserted from outside through corresponding holes in the mount and therefore is securely accommodated on the mount.

The electric connection terminal according to the invention allows for the application of a high clamping force with a large opening angle possible simultaneously, which can reach and exceed 60° or 75°. Even with conductors having large cross sections of 20 $mm^2$, 25 $mm^2$ or 30 $mm^2$ or 35 $mm^2$, zero clamping is facilitated after such a conductor is clamped and removed for the first, in which a thin conductor with diameters of 1 mm, 0.5 mm or less can still be reliably clamped by the clamping lever.

When transferring the electric connection terminal from the open state into the clamped state, the clamping lever is firstly closed to a large extent without force or almost without force before a high clamping force is applied during the further pivoting of the tool.

The electric connection terminal is in particular in the form of a toggle lever terminal that allows a wide variety of conductor cross sections to be connected in a simple, quick and secure manner. The principle of said toggle lever terminal is based on a lever mechanism which is adjoined by a spring mechanism in the form of a clamping spring in order to transmit a very large contact normal force to the conductor. To make it possible to generate such a force without having to make the clamping spring too large and without causing damage to the clamping spring, the spring geometry has to correspond to a particular shape. More preferably, an optimum geometry is used so that the dimensions of the toggle lever terminal as a whole remain within a size used in the switchgear cabinet and preferably also so that little material is used for the clamping spring.

Advantageously, the clamping spring has an at least 1.5 times S-shape. The clamping spring thus acts like two springs connected in series having an increased spring constant while using the same amount of material and having the same overall size. At each end, the clamping spring has a pin receptacle, which is for example eyelet-like, for components that are to be attached. Between the pin receptacles (eyelets), a connection is produced by means of the 1.5 times S-shape. The bend radii, of both the outer bend at the two ends and the central curve, are determined by the force ratio and the spring rate that the clamping spring is to have. If the clamping spring has a high spring constant, the outer radii should be smaller and the central radius should be larger. For a smaller spring rate, the opposite can occur.

The contour can of course also consist of additional springs and of more radii than the 1.5 times "S", and can have any number of S-shapes. The more S-shapes there are, the more rigid the clamping spring.

Preferably, the clamping spring at least substantially comprises an at least 1.5 times S-shape. More preferably, the clamping spring has a 1.5 times S-shape. More particularly, in the region of the 1.5 times S-shape, the clamping spring comprises a curved portion having an outer radius (R2) and two curved portions having inner radii (R1), the curvatures having the inner radii being open towards the side having the first leg and the second leg and the curved portion having the outer radius being open towards the other, opposite side.

In the process, the portions having the curvatures having inner radii are spatially between the first leg and the second leg.

More preferably, the clamping spring consists of the first leg and the second leg and a plurality of curved portions therebetween, i.e. preferably at least two curved portions having inner radii and one curved portion provided therebetween having an outer radius.

It is particularly advantageous for the outer radius (R2) to be larger than the inner radii (R1).

FIG. 1 is a schematic perspective view of a terminal block 200, which consists of a plurality of electric connection terminals 100 according to the invention arranged next to one another in series. Altogether, one housing 150 is provided here for the shown electric connection terminals 100. It is, however, also possible for each individual electric connection terminal to have an individual housing 150. Preferably, such a housing 150 consists of a non-electrically conductive material.

Each individual electric connection terminal 100 has a mount 108, which serves as a retaining body and clamping body. In each case, an upwardly open insertion region and pivot-in region 115 is provided in order to receive an electric conductor 126 or an electric cable 125 in the mount 108 and to clamp it to the current bar 110.

While of the four electric connection terminals 100 shown in FIG. 1, the three on the left are in the clamped state, the connection terminal 100 arranged the furthest on the right is open and is in the open state 144. It can already been seen in the schematic perspective view according to FIG. 1 that the opening angle between the current bar 110 and the clamping lever is very large and is nearly 90° here such that a conductor can be pivoted into the opening from above in a simple manner.

Figure 2:
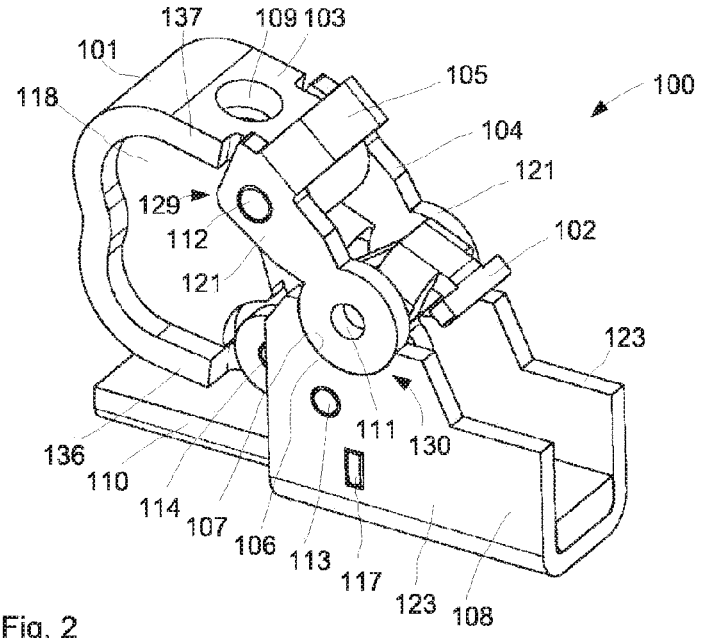
FIG. 2 is a schematic perspective view of a single electric connection terminal.

FIG. 2 is a schematically enlarged perspective view of a single electric connection terminal 100, where the housing 150 has been left out in order to be able to better show and see the individual components.

Figure 6:
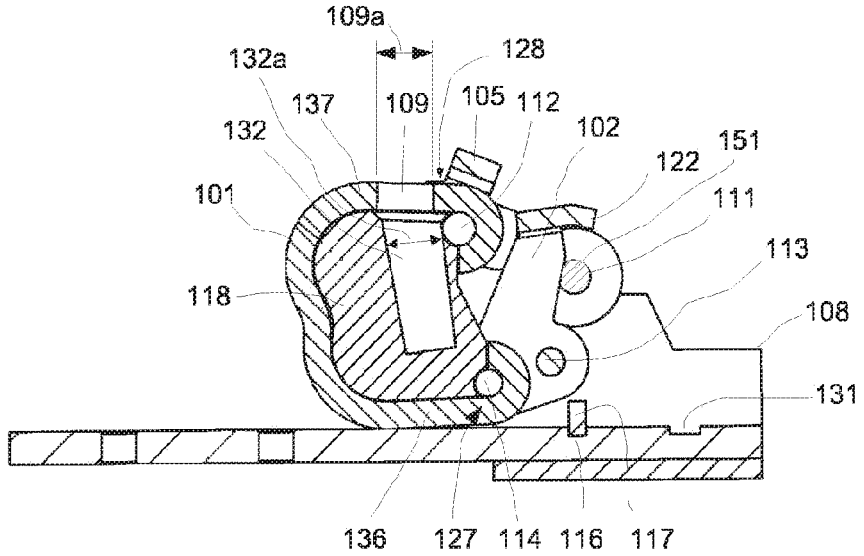
FIG. 6 is a sectional side view of the electric connection terminal.

The electric connection terminal 100 has a mount 108 with two side walls 123, which as a whole has a roughly U-shaped cross section. The mount 108 consists of a punched bent part. The current bar 110 is accommodated on the mount 108. A penetration guard 117 is arranged at a groove 116 (c.f. FIG. 6) and prevents an inserted conductor from passing through and also secures the current bar 110 inside the mount 108.

Furthermore, the electric connection terminal has a clamping lever 102, which is accommodated pivotally on the mount 108 by means of a first pivot pin 113. The clamping lever 102 has a second pivot pin 114, which is arranged at a distance from the first pivot pin 113. On the second pivot pin 114, one end of a first leg 136 of the clamping spring 101 is accommodated pivotally. In this case, the first pivot pin 113 and the second pivot pin 114 are oriented at least approximately in parallel.

Overall, the clamping spring 101 having the first leg 136 and the second leg 137 has a roughly C-shaped form. At the end of the second leg 137, the clamping spring 101 is pivotally accommodated or mounted on the pin 112. The pin 112 is part of the first rotating unit 129 on a first end of the auxiliary lever 104. The auxiliary lever 104 consists of two parallel side walls 121, which are connected to one another by means of a cross link 105. In a front view, the cross link 105 has a roughly U-shaped form in order to allow the second leg 137 of the clamping spring 101 to pivot on the first rotating unit 129 of the auxiliary lever 104. The auxiliary lever 104 is likewise a one-piece punched bent part.

A second rotating unit 130 is provided on the second end of the auxiliary lever 104. In the process, the second rotating unit 130 comprises a central hole 111, into which a plastics journal, which cannot be seen in FIG. 2, engages as the guide pin 151 of the housing 150 (cf. FIG. 6), in order to guide the second rotating unit 130. It is, however, also possible for the second rotating unit 130 to be pivotally mounted at the hole 111.

The second rotating unit 130 and therefore the auxiliary lever 104 are pivotally mounted here by means of the round outer shape 107, which is accommodated at the round recess 106. The virtual axis of rotation extends centrally through the opening 111. When the auxiliary lever 104 is pivoted, the round outer shape 107 of the second rotating unit 130 rotates inside the round recess 106 in the mount 108 about the virtual axis of rotation. Effective transmission of force is facilitated in a direction that is vertical in this case, i.e. in a direction perpendicular to the current bar 110. The virtual axis of rotation through the opening 111 is in this case oriented in parallel with the pin 112 that is in turn oriented at least approximately in parallel with the pivot pin 114.

The clamping spring 101 with its overall roughly C-shaped side view has an insert in the inside of the "C", which is constructed here as a plastics insert 118 and acts as a counter-bearing for a tool 120 (cf. FIG. 3) when the connection terminal 100 is actuated. The clamping spring 101 is subjected to tension here such that, when loaded, the two legs 136 and 137 of the clamping spring 101 separate.

The clamping spring 101 also acts here as an actuating unit 103 or actuating lever and, in addition to the clamping spring 101, also comprises the plastics insert 118. In the second leg 137 of the clamping spring 101, a tool opening 109 is provided, through which a tool 120 such as a screwdriver can be inserted, in order to transfer the connection terminal 100 out of the open state 144 into the clamped state 145 and back again with the movement of the screwdriver.

Figure 3:
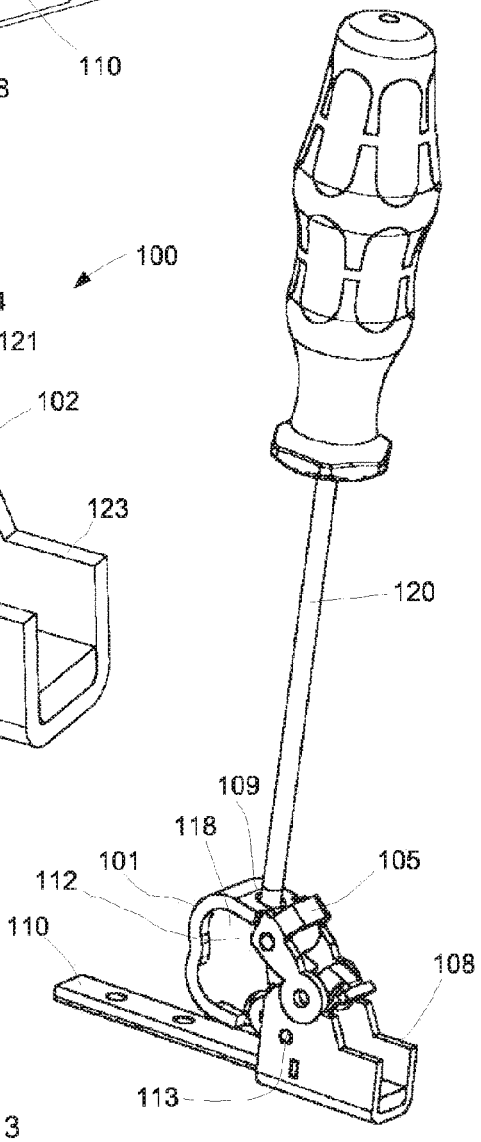
FIG. 3 is a schematic perspective view of the electric connection terminal having an inserted tool.

FIG. 3 is a schematically perspective view of the connection terminal 100 with a plastics insert 118 designed as a plug-in part. By pivoting the tool 120 clockwise, i.e. towards the clamping lever 102, the electric connection terminal 100 is transferred into the clamped state 145.

Figure 4:
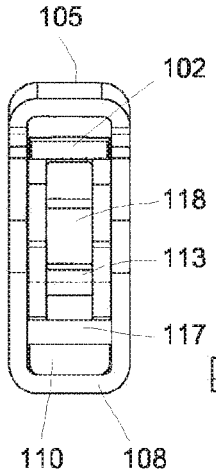
FIG. 4 is a front view of the electric connection terminal.

FIG. 4 is a front view of the electric connection terminal 100, in which the roughly U-shaped form of the mount 108 with the current bar 110 inserted therein can be seen. Also added are the clamping lever 102 with the clamping edge and the plastics insert 118 acting as the counter-bearing and the first pivot pin 113, on which the clamping lever 102 is pivotally accommodated on the mount 108.

Figure 5:
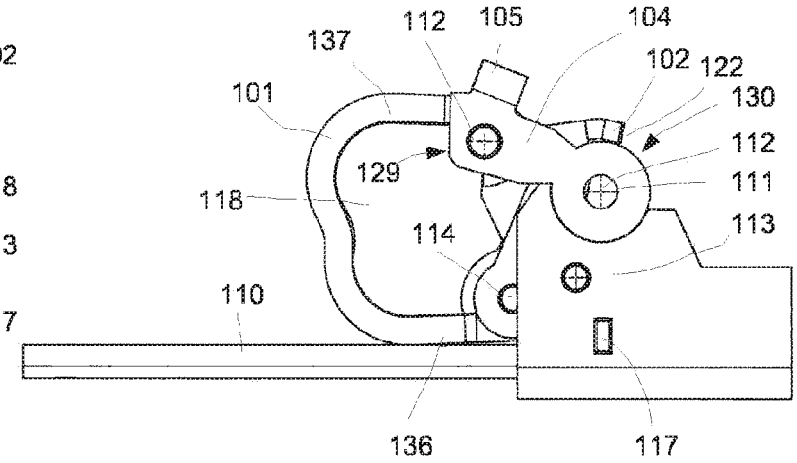
FIG. 5 is a side view of the electric connection terminal.

FIG. 5 is a side view of the electric connection terminal 100. The first pivot pin 113 and the second pivot pin 114 are accommodated on the clamping lever 102. Altogether, the clamping lever 102 can be pivoted about the pivot pin 113 accommodated on the mount 108 such that when the clamping lever 102 is pivoted, the clamping edge 122 is also pivoted.

The first leg 136 of the clamping spring 101 is rotatably accommodated on the second pivot pin 114 of the clamping lever 102. The second leg 137 of the clamping spring 101 can be pivoted relative to the first rotating unit 129 of the auxiliary lever 104. The second rotating unit 130 of the auxiliary lever 104 is rotatably accommodated on the round recess 106 in the mount 108 by means of the round outer shape 107.

FIG. 6 is a sectional side view of the electric connection terminal 100. In the process, the plastics insert 118, which is accommodated on the clamping spring 101, can be seen. An accommodating opening 132 is provided in the plastics insert 118 to accommodate a tool 120. In the process, an inner diameter 109*a* of the tool opening 109 in the clamping spring is provided with a larger diameter than the inner diameter 132*a* of the accommodating opening 132 in the plastics insert 118. As a result of this, the clamping spring 101 can be provided for use with different plastics inserts 118 and with plastics inserts 118 with different accommodating openings 132. This makes it possible to provide different connection terminals 100, where only the plastics insert 118 differs and therefore the operating angle changes.

The clamping lever 102 has two parallel side walls, between which the clamping edge 122 is provided. The clamping lever 102 is also constructed here as a one-piece punched bent part.

In the current bar 110, a groove 116 is provided in which the rod-shaped penetration guard 117 is formed and accommodated in corresponding side openings in the walls 123 of the mount 108. As a result of this, the current bar 110 is secured in the axial direction and moreover, a penetration guard for a conductor 126 is made possible.

Furthermore, a groove 131 is provided in the current bar 110 and is arranged where the clamping edge 122 presses an inserted conductor 126 against the current bar 110. As a result of this, conductors 126 can deform into the groove 131 during the clamping process such that effective protection against it being pulled out can be ensured.

In the sectional view according to FIG. 6, the first pin receptacle 127 can be seen in section on the first leg 136 of the clamping spring 101. In the process, the first pin receptacle 127 engages around the second pivot pin 114 of the clamping lever 102. At the other end of the clamping spring 101, i.e. the second leg 137, the second pin receptacle 128, which engages around the pin 112 of the first rotating unit 129 of the auxiliary lever 104, can be seen in section.

Shown in section, the guide pin 151 is in the hole 111 or virtual axis of rotation of the second rotating unit 130 of the auxiliary lever 104.

Figure 7:
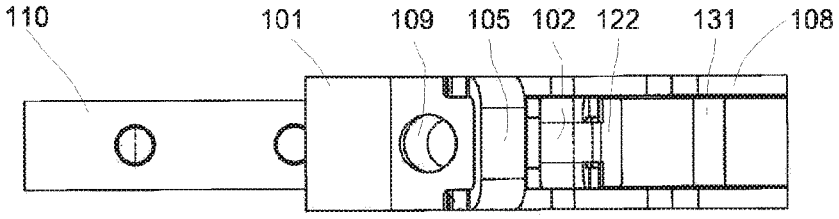
FIG. 7 is a plan view of the electric connection terminal.

FIG. 7 is a plan view of the electric connection terminal 100. The tool opening 109 can be seen in the clamping spring 101. The cross link 105 of the auxiliary lever 104 engages around the second leg 137 of the clamping spring 101. The clamping lever 102 has a clamping edge 122, which is oriented to the right here 122 and, in the clamped state, engages in the groove 131 or presses a conductor against the groove 131 in the current bar.

Figure 8:
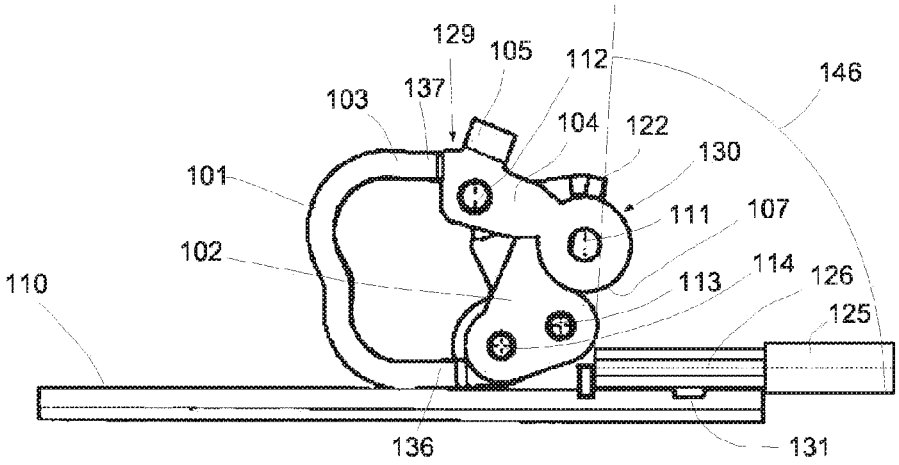
FIG. 8 is a highly schematic side view of the electric connection terminal in the open state.

The operation of the electric connection terminal 100 is described hereinafter with reference to FIGS. 8 to 10. In FIG. 8, a cable 125 having an electric conductor 126 is drawn schematically. In the views according to FIGS. 8 to 10, various parts of the electric connection terminal 100 have been omitted in order to be able to better explain the operation.

The mount 108 has not been shown here in FIG. 8. It must, however, be borne in mind that the clamping lever 102 is connected permanently to the mount 108 by means of the first pivot pin 113. Also the second rotating unit 130 of the auxiliary lever 104 is supported immovably on the mount 108 on the correspondingly round recess 106 therein by the round outer shape 107.

The opening angle 146 between the current bar 110 and the clamping edge 122 of the clamping lever 102 here is much greater than 75° and nearly 90°. Depending on the geometric design of the clamping lever 102, the opening angle 146 can be selected so as to be even greater. Normally, this opening angle 146 is sufficient in order to be able to pivot particularly rigid conductors 126 with large cross sections into the pivoting-in region 115 from above.

Figure 9:
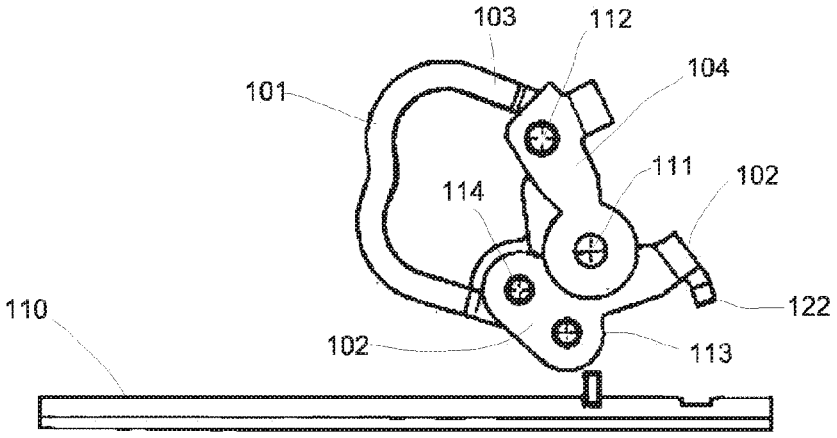
FIG. 9 is a highly schematic side view of the electric connection terminal in an intermediate position.

While FIG. 8 shows the open state 144, FIG. 9 shows an intermediate state in which the clamping lever 102 has already been pivoted considerably. This occurs in that a tool is inserted into the tool opening 109 in the clamping spring 101 and is pivoted clockwise in the views according to FIGS. 8 to 10. During the transfer from the state shown in FIG. 8 into the state shown in FIG. 9, the pivoting takes place practically without force since the distance between the two legs 136 and 137 of the clamping spring 101 does not or practically does not change and therefore the spring tension does not change. As a result of this, comfortable operation is achieved.

In the case of conductors with very large cross sections, the state shown in FIG. 9 can already almost be achieved by resting the clamping edge 122 on the conductor 126. When transferring from the state in FIG. 8 into the state shown in FIG. 9, the clamping lever 102, the clamping spring 101 and the auxiliary lever 104 each pivot in a manner coupled to one another.

Figure 10:
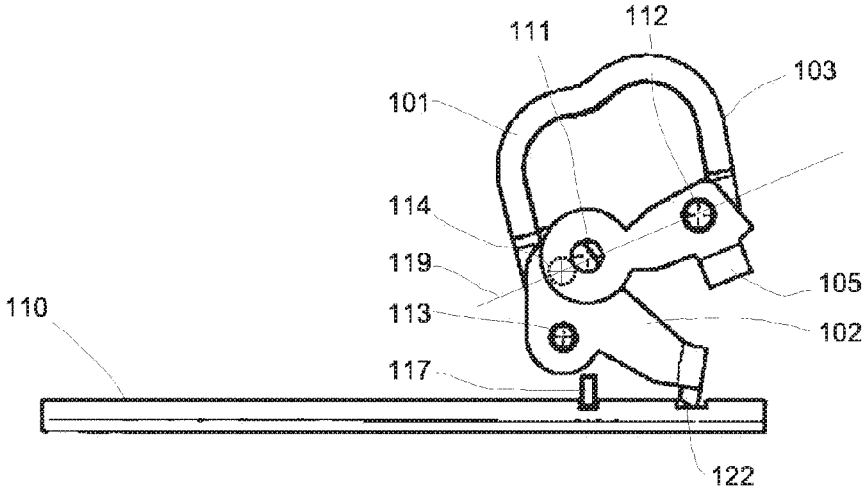
FIG. 10 is a highly schematic side view of the electric connection terminal in the clamped state.

FIG. 10 shows the clamped state 145. It can be seen clearly that zero clamping can also be achieved, in which conductors with the smallest of cross sections can also be clamped. In FIG. 10, the clamping edge 122 abuts the groove 131 in the current bar 110. During pivoting from the state shown in FIG. 9 into the clamped state 145 according to FIG. 10, the clamping spring 101 is tensioned, the distance of the first leg 136 from the second leg 137 widening. A high clamping force is therefore generated as a result of the stable clamping spring 101.

In FIG. 10 a self-retaining state is shown. When the clamping spring 101 and the auxiliary lever 104 are pivoted, a dead centre was exceeded such that in the clamped state 145, the clamping spring 101 is slightly relieved of tension compared with the maximum pre-tension. As a result of this, a stable state is achieved. The self-retaining state can be seen here in that the connecting line 119 between the pin 112 and the second pivot pin 114 extends slightly below the centre of the hole 111 or virtual axis of rotation of the second rotating unit 130 of the auxiliary lever 104. As a result of this, when the electric connection terminal is transferred into the open state 144, the clamping spring 101 is initially pre-tensioned further in order to overcome the dead centre.

The second pivot pin 114 is shown by a dashed line in the view according to FIG. 10 since it is located behind the second rotating unit 130 of the auxiliary lever 104 and is therefore not actually visible in this view.

Figure 11:
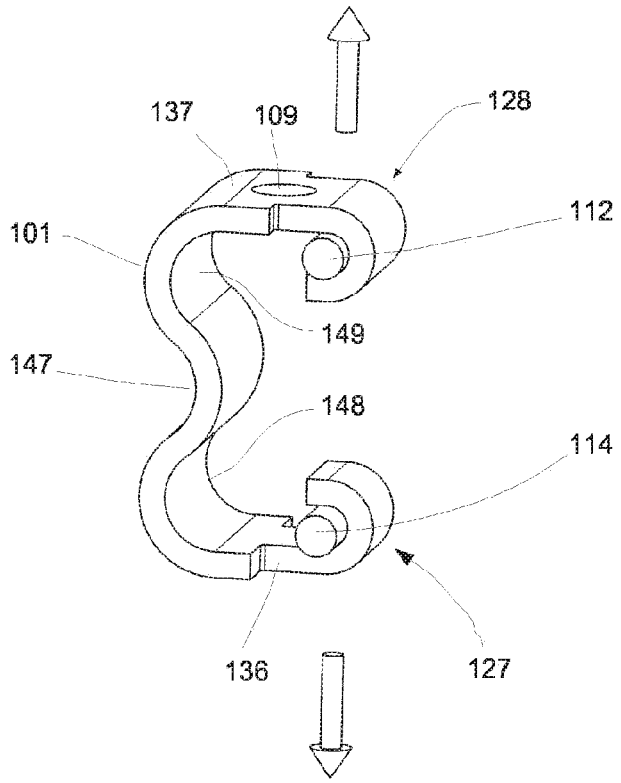
FIG. 11 is a schematic view of the operating principle of the clamping spring for a connection terminal according to FIG. 2.
Figure 12:
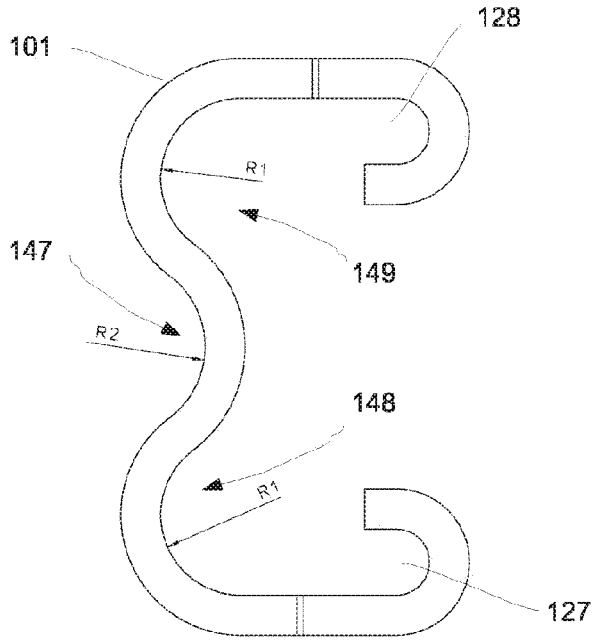
FIG. 12 is a schematic side view of the action of the clamping spring.

Preferably, the clamping spring 101 has an at least substantially 1.5 times S-shape in all the embodiments, as shown in FIGS. 11 and 12.

Preferably, the clamping spring 101 comprises, in the region of the 1.5 times S-shape, a curved portion 147 having an outer radius R2 and two curved portions 148, 149 having preferably identical or similar inner radii R1, the curved portions 148, 149 having the inner radii R1 being open towards the side on which the first leg 136 and the second leg 137 have their free end. The curved portion 147 having the outer radius R2 is in particular open towards the opposite side.

In this case, the portions having the curvatures 148, 149 having the inner radii R1 are spatially between the first leg 136 and the second leg 137.

It is particularly advantageous if the outer radius R2 of the curved portion 147 is greater than the inner radii R1 of the curved portions 148, 149.

Overall, a very advantageous electric connection terminal 100 is provided that can be arranged in series and can be produced from simple components.

The electric connection terminal 100, which is designed as a tilting lever terminal, has a dynamic lever transmission, in which the clamping edge 122 covers a long path at the beginning of the closing process and in which a relatively long distance is travelled by the tool during further closing with low force, which is translated into a high clamping force.

The clamping spring 101 and the clamping lever 102 and the auxiliary lever 104 plus the mount 108 can be produced from punched bent parts. This allows for simple and cost-effective production, even in mass production. The maximum opening angle 146 can be very large such that even the most solid conductors can be pivoted into the pivoting-in region 115 that is upwardly open.

Settlement phenomena on the spring or other components are reliably prevented and as a result of an appropriate selection of wall thicknesses of the clamping spring 101 and the other dimensions, any desired clamping force can be applied in principle.

In order to mount the auxiliary lever 104 with the second rotating unit 130 on the mount 108, the second rotating unit 130 can have a round outer contour 107, which engages in a correspondingly round recess 106 in the mount 108. This is possible since no tensile forces occurs here, and so a simple plastics journal 151 at the hole 111 of the housing 150 suffices.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

| | |
|---|---|
| Connection terminal | 100 |
| Clamping spring | 101 |
| Clamping lever | 102 |
| Actuating unit | 103 |
| Auxiliary lever | 104 |
| Cross link | 105 |
| Recess | 106 |
| Outer shape | 107 |
| Mount | 108 |
| Tool opening | 109 |
| Current bar | 110 |

-continued

| | |
|---|---|
| Hole | 111 |
| Pin | 112 |
| First pivot pin | 113 |
| Second pivot pin | 114 |
| Pivoting-in region | 115 |
| Groove | 116 |
| Penetration guard | 117 |
| Counter bearing, plastics insert | 118 |
| Connecting line | 119 |
| Tool, screwdriver | 120 |
| Side, wall | 121 |
| Clamping edge | 122 |
| Side, wall | 123 |
| Cable | 125 |
| Conductor | 126 |
| First pin receptacle | 127 |
| Second pin receptacle | 128 |
| First rotating unit | 129 |
| Second rotating unit | 130 |
| Groove | 131 |
| Accommodating opening | 132 |
| First leg | 136 |
| Second leg | 137 |
| Open state | 144 |
| Clamped state | 145 |
| Opening angle | 146 |
| Curvature | 147 |
| Curvature | 148 |
| Curvature | 149 |
| Housing | 150 |
| Pivot, guide pin | 151 |
| Terminal block | 200 |
| Radius | R1 |
| Radius | R2 |

The invention claimed is:

1. A connection terminal for connecting at least one conductor to a current bar, which is accommodated on a mount, in an electrically contacting manner, the connection terminal comprising:

at least one clamping spring configured to apply a clamping force; and a pivotable clamping lever configured to clamp the conductor, wherein the clamping spring has a first leg and a second leg, is hingedly coupled to the clamping lever by the first leg, and is hingedly coupled to an auxiliary lever by the second leg, the clamping lever and the auxiliary lever being arranged pivotally on the mount.

2. The connection terminal of claim 1, wherein, in an open state, an opening angle between the current bar and a clamping edge of the clamping lever is greater than 45°.

3. The connection terminal of claim 1, wherein a first pivot pin and at least a second pivot pin at a distance therefrom are arranged on the clamping lever, the clamping spring has a first pin receptacle and a second pin receptacle at a distance therefrom, and the auxiliary lever has a first rotating unit and a second rotating unit at a distance therefrom.

4. The connection terminal of claim 3, wherein the clamping lever is pivotally attached to the mount by the first pivot pin.

5. The connection terminal of claim 3, wherein the first pin receptacle of the clamping spring is provided on the first leg of the clamping spring and the second pin receptacle of the clamping spring is provided on the second leg of the clamping spring.

6. The connection terminal of claim 3, wherein the first rotating unit of the auxiliary lever has an pin which is pivotally connected to the second pin receptacle of the second leg of the clamping spring and the second rotating unit of the auxiliary lever is pivotally arranged on the mount.

7. The connection terminal of claim 3, wherein the second rotating unit of the auxiliary lever has a rounded outer contour which is pivotally accommodated on a matching rounded recess in the mount.

8. The connection terminal of claim 3, wherein the second rotating unit of the auxiliary lever comprises an opening into which a guide pin is inserted.

9. The connection terminal of claim 1, wherein the clamping spring is part of an actuating unit and the actuating unit at least one of has a tool opening or comprises a tool receptacle on an insert.

10. The connection terminal of claim 9, wherein an inner diameter of the tool opening is greater than an inner diameter of the tool receptacle.

11. The connection terminal of claim 9, wherein the actuating unit is configured to act on the clamping lever via the auxiliary lever.

12. The connection terminal of claim 1, wherein the clamping spring is at least one of configured to act as a tension spring in a clamped state or is substantially relieved of tension in a open state.

13. The connection terminal of claim 1, wherein the clamping lever is located behind a dead centre in a clamped state.

14. The connection terminal of claim 3, wherein at least one of an end of the first leg or an end of the second leg of the clamping spring is bent to form at least one of the first or the second pin receptacle.

15. The connection terminal of claim 1, wherein at least the mount, the clamping lever, and the auxiliary lever are punched bent parts.

16. The connection terminal of claim 1, wherein the current bar is provided with at least one of a groove configured to secure an accommodated conductor or a penetration guard for an accommodated conductor.

17. The connection terminal of claim 1, wherein the clamping spring has a 1.5 times S-shape.

18. The connection terminal of claim 17, wherein the clamping spring comprises, in a region of the 1.5 times S-shape, a curved portion having an outer radius (R2) and two curved portions having inner radii (R1), wherein the two carved portions having the inner radii (R1) are open towards the first leg and the second leg and the curved portion having the outer radius (R2) is open towards the other side.

19. The connection terminal of claim 18, wherein the outer radius (R2) is greater than at least one inner radius (R1).

20. The connection terminal of claim 2, wherein the opening angle is greater than 60°.

* * * * *